United States Patent [19]

Rhodes

[11] 4,039,185

[45] Aug. 2, 1977

[54] INDIAN-WRESTLING DEVICE

[76] Inventor: Robert V. Rhodes, 1185 Hillcrest Ave., Pasadena, Calif. 91106

[21] Appl. No.: 610,649

[22] Filed: Sept. 5, 1975

[51] Int. Cl.[2] ..... A63F 9/00; A63B 67/00

[52] U.S. Cl. ..... 273/1 R; 272/68

[58] Field of Search ..... 273/1 R; 272/57 R, 67, 272/68, 69, 79 R

[56] References Cited

U.S. PATENT DOCUMENTS

| | | | |
|---|---|---|---|
| 484,352 | 10/1892 | Ayton | 272/84 |
| 1,884,392 | 10/1932 | Treat | 272/68 |
| 2,714,008 | 7/1955 | Urban | 272/67 X |
| 2,782,033 | 2/1957 | Ugartechea | 272/67 |
| 3,013,799 | 12/1961 | Wise | 272/132 |
| 3,089,700 | 5/1963 | Hotas | 272/117 X |
| 3,129,940 | 4/1964 | Lauro | 273/1 R |
| 3,219,342 | 11/1965 | Melchiona | 272/68 |
| 3,467,376 | 9/1969 | Feinberg | 273/1 R |
| 3,525,522 | 8/1970 | Piller | 272/79 R |
| 3,559,487 | 2/1971 | Parlato | 272/79 R |
| 3,743,284 | 7/1973 | Rhodes | 273/1 R |
| 3,879,034 | 4/1975 | Potrusek | 273/1 R |

*Primary Examiner*—William H. Grieb

*Attorney, Agent, or Firm*—D. Gordon Angus; Donald D. Mon

[57] ABSTRACT

Devices are disclosed for use in the sport of Indian wrestling. In such a contest each of two contestants is to stand at a prescribed place such as on areas marked on a board. Each contestant holding one side of the device attempts by moving the device to unbalance the other contestant to cause him to shift his footing and thereby lose the contest. Each of the several embodiments of the wrestling device disclosed comprises a block having means for grasping it.

In some embodiments the movement of the device by one contestant is fully resistible in all degrees of freedom of movement by the other, while in other embodiments one part can swivel relative to another, reducing in number the degrees of freedom of movement which can be resisted, and thereby changing the sport remarkably.

5 Claims, 12 Drawing Figures

10
11
12
13

12
12a
12b
12c
12d
14
15
16

13
17
18
19
20
21
22
23
24
25
26
27
28

30
30a
30b
31
32
33
34
35
36
37
38
39
40
41
42
44
5

31
41
42
43
44

55
56
57

45
46
47
48

50
51
52
53
54

75
76
77
78
79

67
69a
69b
70a
70b
71a
71b
72a
72b
73a
73b
74

60a
60b
61
62
63
64
65
66
67
68a
68b
74
10

80
81
82
83
84
85
86
87
88
89
90

INDIAN-WRESTLING DEVICE

This invention relates to equipment useful for indian wrestling. Indian wrestling has long been known as a sporting contest. In the contest each contestant uses one arm in a test of strength or skill. Usually each grasps the hand of the other, and attempts to unbalance the other so that he cannot maintain his set footing at which the contest started.

The contest, if it is to be one of skill and strength, should be defined, if possible, so that strength in the movement of the arm and wrist, and quickness of movement and counter-movement, are the determinants. Unfortunately, when the contestants grip hands, the strength of grip becomes a serious variable to be considered which has nothing to do with the primary intended capacities to be tested one against the other. These can all adversely be overcome by a crushing grip.

Accordingly, it is an object of this invention to "decouple" the hands of the contestants. Instead, they each grip a rigid device which isolates one contestant from the grip of the other. Then there remains to be tested only the strength of wrist and arm, and quickness of each member.

Also it may be desired to isolate the contestants from the variable of twist of the wrist, so as to define the contest as one which lacks response in the two degrees of freedom, namely torque (twist) in either direction. Then the contest is one of push-pull and sideward and upward displacement. This is a much truer test of agility and arm strength.

The invention is carried out by provision of a device having grasping structure which may firmly be grasped by each contestant in a manner useful in his attempt to unbalance the other contestant.

According to an embodiment of the invention, the device comprises a body having a pair of openings at opposite sides through which a part of the hand or fingers may be passed so the body can body can be gripped by the hand.

A desirable feature resides in the provision of means accommodating individual fingers, in at least some embodiments.

A feature of at least one embodiment resides in means for producing a swivelling action of one member of the body relative to another member of the body.

In embodiments comprising separable block members, there is the advantage that two parts of the body may be joined for use in the contest, each having a gripping configuration best suited in size and conformation to be gripped by the respective contestant.

The foregoing and other features and advantages of the invention will be better understood from the following detailed description and accompanying drawing, in which.

Figure 1:
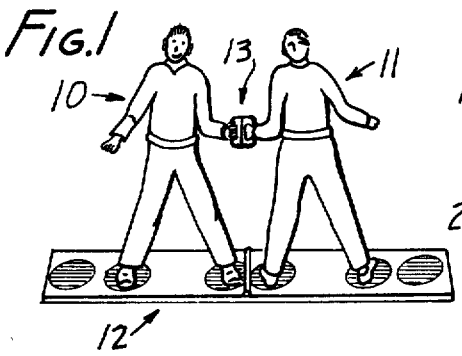
FIG. 1 illustrates two indian-wrestling contestants making use of a device according to this invention.
Figure 2:
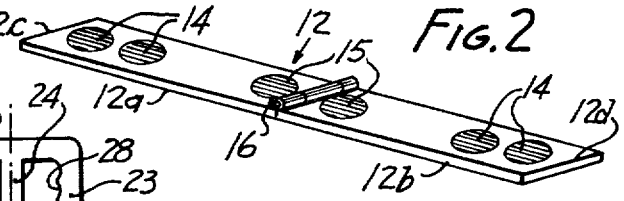
FIG. 2 is a perspective view of a board on which the wrestlers of FIG. 1 are standing.

Referring to the drawing, FIG. 1 shows two indian wrestling contestants 10 and 11 standing on a board 12 (sometimes called a "platform") shown in perspective in FIG. 2, engaged in an indian-wrestling contest, by using a device 13 according to this invention. The board is shown made in two segments **12*a* and 12*b* of equal length joined end to end by a hinge 16 of an ordinary piano hinge type, so that the board may for convenience be folded on itself by means of the hinge with one end 12*c* brought against the other end 12d**, so that the surfaces of the two segments are flush with each other when not in use. It can then more conveniently be stored or carried.

Each of the segments **12*a* and 12*b* of the board is provided with an equal number of areas 14, preferably colored differently from the background color of the board, and other areas are located on opposite sides of the hinge. One foot of each wrestler is to be placed in a respective area 15 against the hinge and the other foot of each wrestler is placed in a respective one of the areas 14. It will be convenient to provide more than one area 14** to accommodate the distance between feet of different-sized persons.

The preferred shape wrestling device 13 is in the form of a rectangular block, rigid in all directions, provided with openings 17 and 18 of equal size and dimensions having their adjacent sides equally spaced from a central plane 19 and their remote sides equally spaced from the far sides 20 and 21 of the block. The block thus comprises two side legs 22 and 23 and a central leg 24, all extending parallel to the central plane and each other and with their ends joined by respective end legs 25 and 26. The inner walls of side legs 22 and 23 are each provided with four grooves 27 and 28 respectively, dimensioned to accommodate the four fingers of the contestants, as illustrated in FIG. 1. It will be understood that the dimensions, including the thicknesses of the side legs 21 and 22, will be such as to permit the contestants to grip their respective side legs firmly. A wrestling contest can be conducted by use of the device 13 without the use of the particular board 12, or even of any board, if desired.

From the foregoing description it will be seen that the equipment illustrated facilitates the art of indian-wrestling, the objective being for each contestant to try to move the other off-balance so that he must remove at least one of his feet from the assigned foot positions. Use of a board like that of FIG. 2 facilitates ascertaining when the feet are initially in the correct places, and when a foot is forced away from a correct place.

Figure 3:
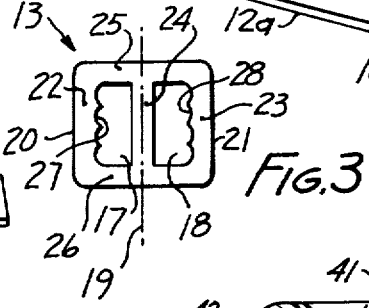
FIG. 3 is an elevation view of the device of FIG. 1.
Figure 4:
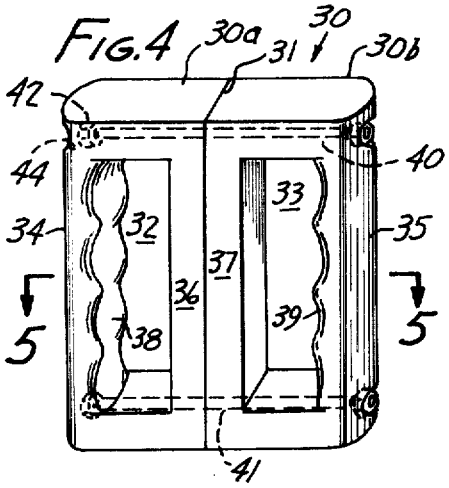
FIG. 4 is a perspective view of another form of wrestling device according to this invention.
Figure 5:
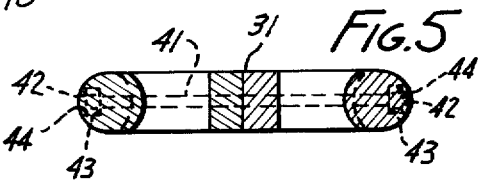
FIG. 5 is a cross-section taken at line 5—5 of FIG. 4.

The modified form of wrestling device 30 illustrated in FIGS. 4 and 5 differs from device 13 of FIG. 3 in that the block comprises two block members **30*a* and 30*b*, which abut each other at a central plane 31 which corresponds with the central plane 19 of FIG. 3. Each of the block members 30a and 30b has openings 32 and 33 respectively, corresponding to respective openings 17** and 18 of FIG. 3 and each block member also has a side leg 34 and 35 respectively parallel to the central plane, corresponding to respective side legs 22 and 23 of FIG. 3. The inner abuting members 36 and 37 of the respective blocks when held together in abutment as illustrated, constitute a central leg corresponding to central leg 24 of FIG. 3. The inner walls of the side legs 34 and 35 are provided with finger grooves 38 and 39 corresponding with finger grooves 27 and 28 of FIG. 3. For the purpose of holding the two block members 30*a* and 30*b* together in abutment as shown, studs 40 and 41 are passed through aligned holes at the upper and lower parts of the block members so that nuts 42 attached to their threaded ends can be tightened against shoulders 43 at the inner ends of enlarged bores 44 in the respective block members. It is seen that the fastened studs hold the blocks in rigid, immovable and unbendable relationship to each other.

Figure 6:
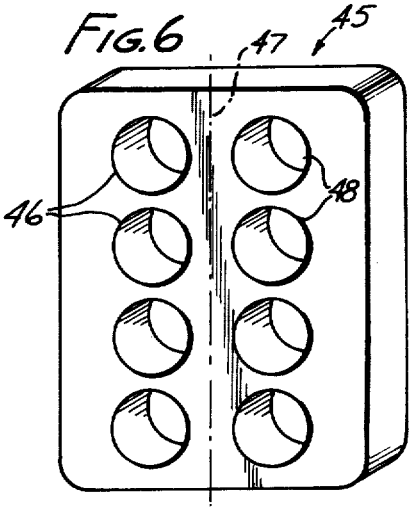
FIG. 6 is an elevation view in perspective of another embodiment of wrestling device according to this invention.

FIG. 6 shows a device comprising a block 45 which may have about the same over-all dimensions as the blocks of FIGS. 3, 4 and 5, in which the finger grips comprise holes. Thus there is a set of four aligned holes 46 at one side of the central plane 47 and another similar set of aligned holes at the same distance at the opposite side of the central plane these sets of holes being immovable relative to each other. The holes 46 are to accommodate the four fingers of one contestant and the holes 48 will accommodate the four fingers of the other contestant and the holes of each set are aligned in a direction parallel to the central plane.

Figure 7:
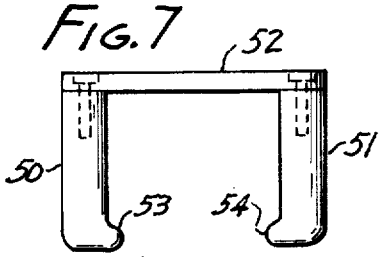

FIG. 7 shows a modification of a device in which the hand grip of one contestant is a cylindrical or rounded member 50 and the hand grip for the other contestant is a similar member 51 parallel with, and spaced from, member 50. One end of each of members 50 and 51 is attached to an end of a bar 52. The ends of the members 50 and 51 which are unattached to the bar are provided with a protuberance 53 and 54, respectively, shaped to comfortably accommodate the hands of the respective contestants. Thus, one contestant grasps one member 50 and the other contestant grasps the other member 51.

Figure 8:
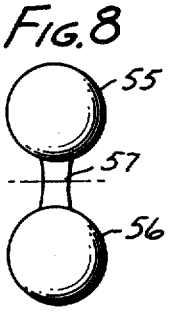
FIGS. 7, 8 and 9 are elevation views of still other embodiments of wrestling devices according to this invention.

FIG. 8 shows a form of device comprising two spheres 55 and 56 attached to and joined by a bar 57 which provides the desired separation between the spheres which are immovable relative to each other. Each of the contestants grasps one of the spheres.

Figure 10:
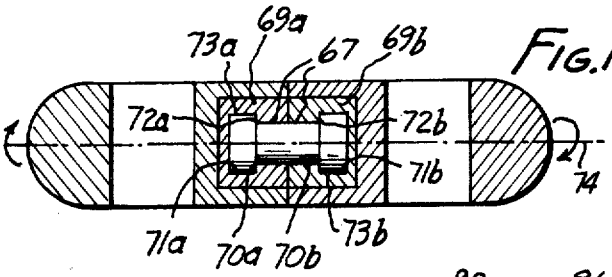
FIG. 10 is a cross-section view taken at line 10—10 of FIG. 9.
Figure 9:
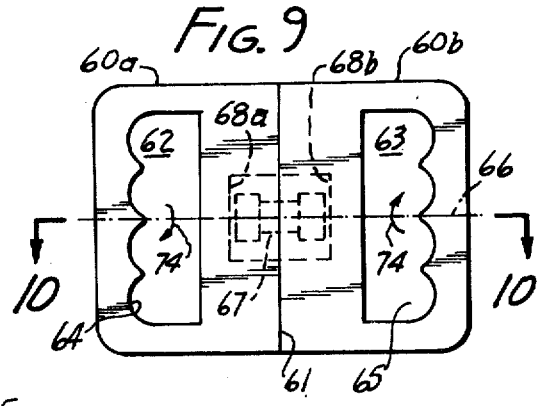

The device of FIGS. 9 and 10 is somewhat similar to that of FIGS. 4 and 5, in that it comprises two block members 60a and 60b abutting each other at a central plane 61. The blocks are provided with openings 62 and 63 corresponding to the openings 32 and 33 of FIG. 4 and with finger grooves 64 and 65 corresponding with finger grooves 38 and 39 of FIG. 4. Although the block members 60*a* and 60*b* abut each other at the central plane, they are not immovable relative to each other. Instead they are made to swivel about an axis 66 which is perpendicular to the central plane, by means of a swivel pin 67. Although the blocks are rotatable to each other about axis 66 they are immovable and unbendable relative to each other in the direction of the axis.

For the purpose of installing the swivel pin, each of the block members 60*a* and 60*b* is provided with a cutout 68*a* and 68*b*, respectively, juxtaposed to each other at the central plane 61 so that the two cut-outs together form a cavity centrally in the block when the block members are brought together in the position shown in FIGS. 9 and 10. Insert block members 69*a* and 69*b* are provided to be fitted into the respective cutouts 68*a* and 68*b*. Each of the insert block members is provided with a bore 70*a* and 70*b* aligned with each other and equal in diameter and enlarged at opposite ends at 71*a* and 71*b* respectively, to form shoulders 71*a* and 72*b*. The cylindrical swivel pin 67 has a diameter enabling it to fit rotatably through the bores 70*a* and 70*b*. To the outer ends of the swivel pin there are attached enlarged cylindrical flanges 73*a* and 73*b* 23 which fit within the enlarged bores 71*a* and 71*b* and abut the respective shoulders 72*a* and 72*b*. The swivel pin may be assembled with the insert blocks by inserting the pin through bores 70*a* and 70*b* in the position shown in FIGS. 9 and 10, and then fastening the flanges to the ends of the pin.

After assembling the swivel pin with the two block members 69*a* and 69*b* the insert blocks are inserted within the cut-outs of the respective block members 60*a* and 60*b*, and secured therein by suitable means such as glue or other means so that the block members 60*a* and 60*b* are held together in abutment by reason of the flanges 73*a* and 73*b* bearing against the shoulders 72*a* and 72*b*. This will hold the block members 60*a* and 60*b* from being pulled away from each other, but rotation of the block members relative to each other can occur as indicated by arrows 74. In this rotational swivelling action blocks 69*a* and 69*b* are free to rotate relative to the pin 67.

Figure 11:
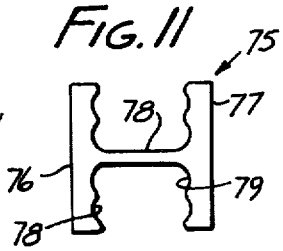
FIG. 11 is an elevation view of still another embodiment of wrestling device according to this invention.

The device 75 of FIG. 11 is a block in the configuration of the letter H. It comprises a handle 76 for use by one contestant and another handle 77 for use by the other contestant. The handles 76 and 77 are maintained rigidly in a spaced, parallel attitude by means of a central arm 78 attached at a central position of both handles. The central arm is flat and thin enough that it can fit between the second and third fingers without undue interference. As in the case of other embodiments herein the handles 76 and 77 are provided with finger grips 78 and 79 at the respective inner sides thereof.

Figure 12:
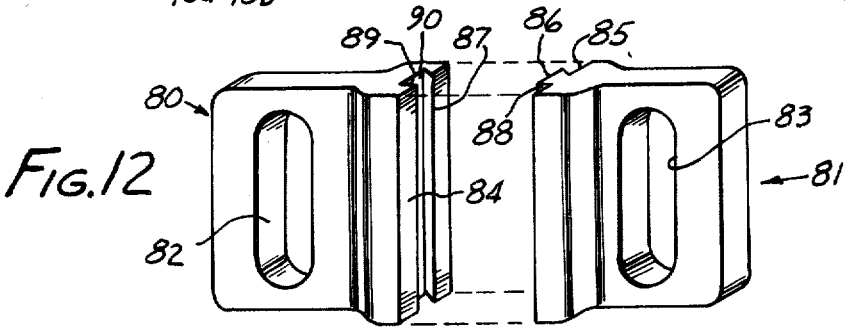
FIG. 12 is a perspective view showing two separated parts of yet another embodiment of wrestling device according to this invention.

FIG. 12 shows two block members 80 and 81 adapted to be separated and to be readily attached together as desired. The block members have respective openings 82 and 83 which may be similar in this respect to the block members 30*a* and 30*b* of FIGS. 4 and 5, and are provided with inner surfaces 84 and 85 which mate with each other at a central plane corresponding to the central plane of FIG. 4. Instead of the two block members 80 and 81 being attached by studs as in FIG. 4, they are attached by a tongue and groove arrangement which maintains the two blocks in rigid, unbendable and immovable relationship to each other. This comprises a tongue 86 protruding from the surface 85 from the block member 81 and a corresponding groove 87 cut or formed inward from the surface 84 of the other block member 80. The tongue 86 is undercut at 88 where it joins the surface 85 at both sides of the tongue and the groove is correspondingly undercut at 89 so that its inner wall 90 has a greater dimension than the opening of the groove at surface 84. The tongue and groove both extend in a vertical direction as seen in FIG. 12 so that the tongue may be slid into the groove either from the top or the bottom of member 80, thus holding the mating surfaces 84 and 85 of the block members together to form a complete block ready for use.

When the device is formed from one piece only, the gripping means will be shaped to accommodate as wide a range of individual grips as possible. Persons knowledgeable in the handle art will readily recognize the proportions and dimensions for this.

However, in the event that a better fit is desired, especially when contestants with hands of very different sizes are to use the device, it is convenient to form the device from at least two parts. Of course, there should be a standard joinder means. Then small, medium and large sizes can variously be joined, or the individuals can bring with them to the contest their own personally fitted grip means. Making the device from a plurality of parts provides this capability.

When the twist is to be eliminated as a competitive factor, a swivel joint with rotational freedom will be provided as in FIG. 10. The two parts can freely swivel without resistance. But there is translational resistance, so that forward-back; up-down; and sideward movement is resisted.

It will be understood that the embodiments of the invention illustrated and described herein are given by way of illustration and not of limitation, and that modifications or equivalents or alternatives within the scope of the invention may suggest themselves to those skilled in the art.

I claim:

1. A device for indian wrestling between two contestants comprising:

a body having a central plane and comprising two rigid blocks which abut at said central plane, and fastening means joining the two blocks in abutment, said fastening means comprising means which hold the two blocks immobile and unbendable relative to each other; and a pair of parallel handle means located at opposite sides of said central plane, each block containing one of said handle means, and each handle means extending parallel to the central plane and being adapted to be grasped by a hand of a respective one of the contestants.

2. A device according to claim 1 in which the fastening means comprises stud means.

3. A device according to claim 1 in which the fastening means comprises a tongue on one of the blocks and a mating groove in the other of the blocks.

4. A device according to claim 1 in which the fastening means comprises tie rods.

5. In combination: a platform having indicia of a design which delineates foot positions indicating the intended location of the feet of a pair of indian wrestling contestants; and a device for indian wrestling between two contestants comprising a body having a central plane, and a pair of hand grip means located at opposite sides of said central plane, each grip means being adapted to be grasped by a respective one of the contestants, said body comprising two blocks which abut at said central plane, and fastening means joining the two blocks in abutment, said fastening means comprising means which hold the two blocks immobile relative to each other.

* * * * *